United States Patent [19]

Orozco

[11] 3,987,571

[45] Oct. 26, 1976

[54] PORTABLE SUBMACHINE GUN

[76] Inventor: Hector Mendoza Orozco, Adolfo Prieto 1709, Mexico 12, D. F., Mexico

[22] Filed: June 30, 1975

[21] Appl. No.: 591,567

Related U.S. Application Data

[62] Division of Ser. No. 433,162, Jan. 14, 1974, Pat. No. 3,906,833.

[30] Foreign Application Priority Data

Jan. 31, 1973 Mexico ..... 141299

[52] U.S. Cl. ..... 42/71 R

[51] Int. Cl.[2] ..... F41C 23/00

[58] Field of Search ..... 42/71 R, 71 P, 75 R, 42/75 C

[56] References Cited

UNITED STATES PATENTS

| | | | |
|---|---|---|---|
| 1,357,208 | 10/1920 | Payne | 42/71 R |
| 2,683,948 | 7/1954 | Catron | 42/72 |

FOREIGN PATENTS OR APPLICATIONS

| | | | |
|---|---|---|---|
| 571,902 | 9/1945 | United Kingdom | 42/71 P |

*Primary Examiner*—Stephen C. Bentley
*Attorney, Agent, or Firm*—Ladas, Parry, Von Gehr, Goldsmith & Deschamps

[57] ABSTRACT

The present invention refers to an improved portable firearm, of the rapid fire (sub-machine gun) type, comprising a support structure in which firing and safety means are contained and to which support structure, on its under side, a handle or grip is attached and which handle includes, inside, a removable magazine; on its back side, the upper portion of an end of a stock, the lower part of which stock is fixed to the handle; in its upper front part, a barrel and thereon a sliding bolt which includes in its back portion an invertable and reusable firing pin; in its upper back portion, a guiding means for the removable bolt, included in which is a movable raised portion which carries an orifice for aiming and in its lower front side, an open cover as a hand grip when firing.

1 Claim, 14 Drawing Figures

PORTABLE SUBMACHINE GUN

This is a division of application Ser. No. 433,162 filed Jan. 14, 1974, now U.S. Pat. No. 3,906,833.

BACKGROUND OF THE INVENTION

To date, a great variety of rapid fire sub-machine guns or rapid fire pistols are known, which generally function by means of a mechanism known as an open cover inasmuch as these are low pressure arms. These arms always include a case inside of which the firing and safety mechanism are located, as well as the fire-arm bolt, and to which case the grip of the firearm is joined, together with or separately from the magazine of the same, the barrel and, optionally, a detachable or folding stock.

These known sub-machine guns have many disadvantages; thus when the stock is needed, since the barrel is joined to the case, these firearms turn out to be of considerable length, and therefore very cumbersome. In order to avoid the above, folding stocks were thought of; nevertheless, these also have disadvantages because after firing or when needed to strike with, they are not very adequate inasmuch as they bend since they are not fixed.

Another disadvantage of the folding stock is that in the case of combat fractions of a minute are very important, and getting the stock in place slows down the operation.

One of the greatest problems and disadvantages of the known sub-machine guns is that when the bolt is included within the case it can always jam due to foreign matter getting into the case; this is very dangerous because when it is not possible to move the bolt in time to free the firing mechanism of the firearm, or it moves in an inadequate manner, the desired shot will not be produced or said shot will be interfered with and thus dangerous to the shooter.

Aside from the aforementioned disadvantages, another difficulty with having the bolt inside the case is that the cleaning of the same is complicated and requires appreciable time, time that must be taken into consideration for, as has already been said, in the case of combat, it is all important.

An additional problem with the interior bolt is that it requires guides which guide it in its travel and, also, it includes only a simple dwell or retention lever on the same.

Another of the problems of the known sub-machine guns is that the type of safety used is generally related to the trigger or firing device, which in reality does not provide for complete reliability inasmuch as on many occasions it allows the arm to fire without squeezing the trigger; and this causes innumerable accidents since there is no set target. Also we can not really be certain that the firearm is not ready to fire. And there is no assurance against this because if the firearm were for example to be dropped and strike on the back side it would actually fire as the bolt moved as a result of the shock of the fall; and consequently said accidents can occur.

Another disadvantage of this type of known firearms is that in all of them, after they have been used for some time, the firing pin or device that causes the detonation of the primer of the cartridges deteriorates and does not function properly and therefore must be replaced by a new one.

Finally, another problem with the known sub-machine guns is that the sight included in the chamber is fixed and in many cases there is no way to adjust it according to the conditions of firing the firearm. Consequently these arms do not afford very accurate aim, and in firearms this is definitely necessary.

OBJECTS OF THE INVENTION

It is therefore one of the objectives of the present invention to provide an improved portable firearm of the rapid fire type (submachine gun), which is very compact, and which has a fixed stock with which adequate support is obtained for firing a good shot, also, that it may be safely used for striking; and furthermore, in the case of combat that there be no loss of time in bringing the stock into place.

Another object of the present invention is to provide an improved portable firearm of the sub-machine gun type in which it is difficult for the bolt to jam because of foreign matter inasmuch as, since it is exposed, a simple shaking or hand wipe will eliminate said foreign matter.

An additional object of the present invention is to provide an improved portable firearm of the sub-machine gun type which includes a bolt which does not have any guides inasmuch as it is designed in such a way that it functions in an adequate way without such guides.

Another objective of the present invention is to provide as improved portable firearm of the sub-machine gun type in which the bolt is brought into firing position by means of a double fastener, which is to say, by means of two detention levers.

Another objective of the present invention is to provide an improved portable firearm of the sub-machine gun type which has a safety in addition to the one on the trigger, and said additional safety prevents the movement of the bolt except when the firearm is gripped and therefore if the firearm falls it cannot fire.

Another object of the present invention is to provide an improved portable firearm of the sub-machine gun type which comprises an invertable and reusable firing pin, because once the end of the same has deteriorated due to use, the firing pin is removed from its lodging and is inverted, thus affording a new firing pin.

It is another object of the present invention to provide an improved portable firearm of the sub-machine gun type which has a rear sight which is adjustable on its transverse axis for more accurate aiming as firing conditions require.

Finally, it is an object of the present invention to provide an improved portable firearm of the sub-machine gun type which comprises a support structure in which the firing and safety means are mounted; to which a grip, a stock and a barrel are fixed; and to which a sliding bolt is joined, said sliding bolt including an invertable firing pin, a guiding means for the bolt and an open cover both removable.

These and other objects to be provided in practice by the present invention will be better understood and appreciated by reading the following description which refers to the drawings of the preferred embodiment of the present invention.

DESCRIPTION OF THE DRAWINGS

FIG. 3 is a vertical elevational side view which illustrates the support structure which houses the safety and firing means of the firearm of the present invention, and shows with dotted lines the functioning of said means and, specifically, shows the firing function in the single shot or repeating fire position.

FIG. 12 also illustrates, in a vertical lateral elevational view, the pin by which the guiding means shown in FIG. 12 is secured.

DETAILED DESCRIPTION OF THE INVENTION

Figure 1:
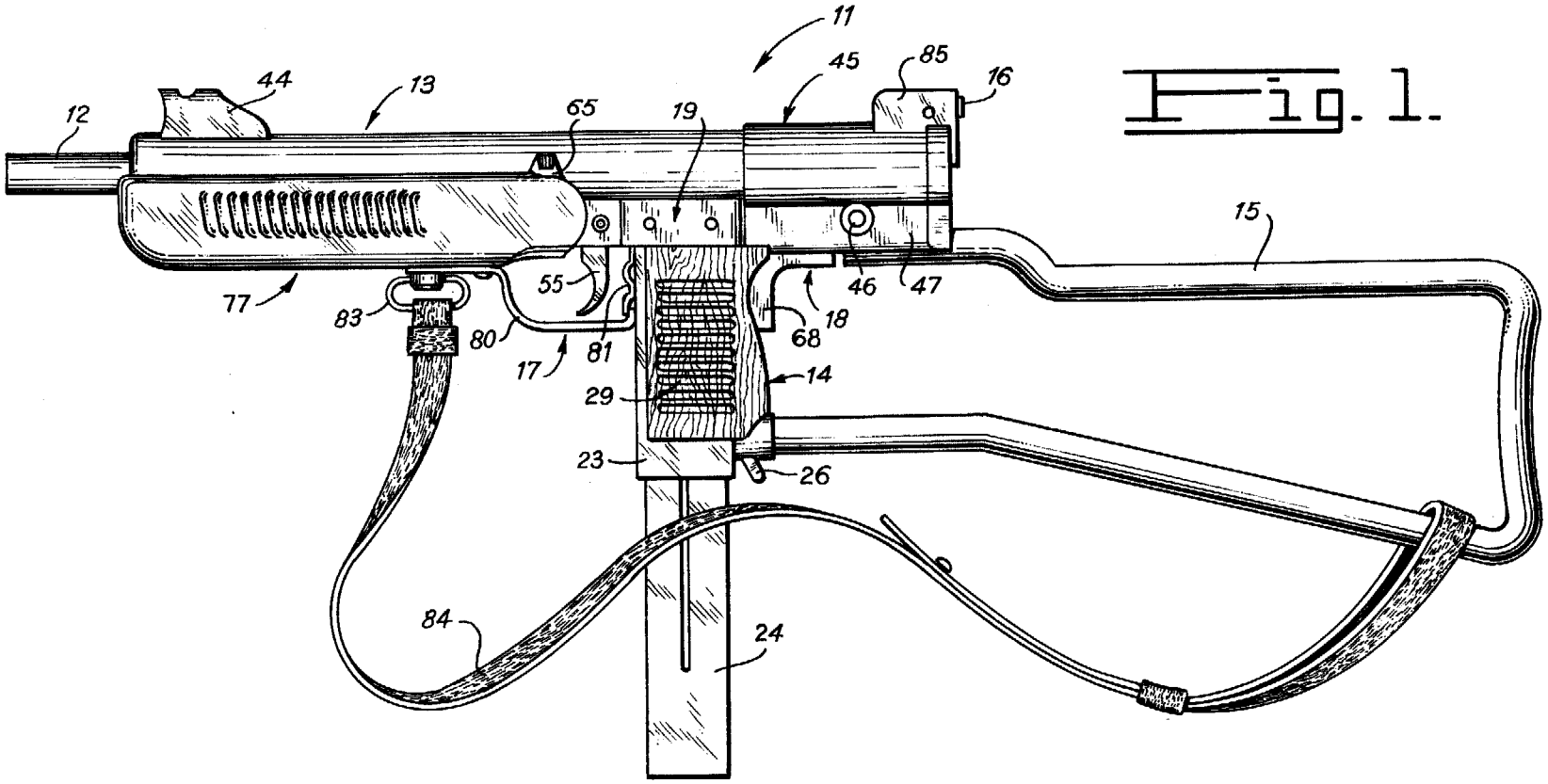
FIG. 1 is a vertical lateral elevational view which illustrates the improved portable firearm of the sub-machine gun type subject of the present invention.
Figure 2:
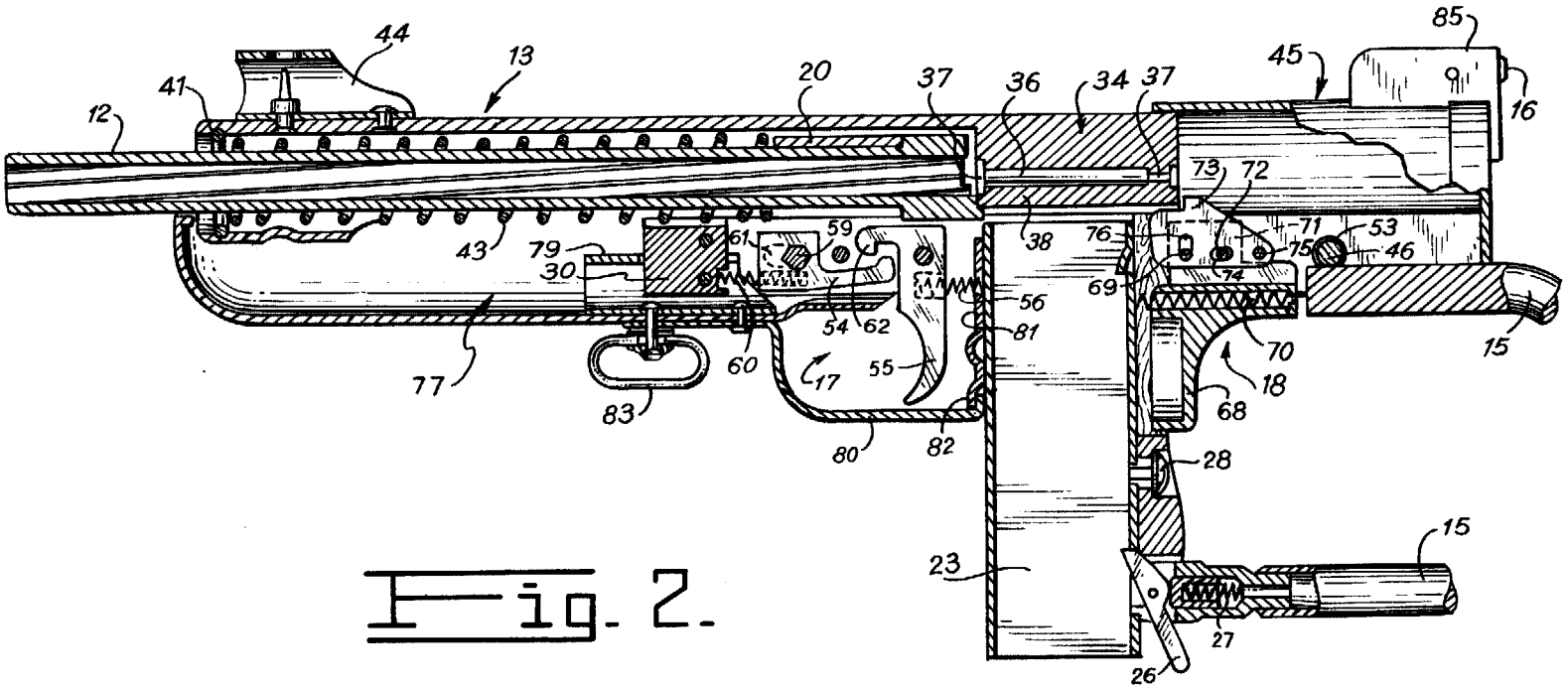
FIG. 2 is a vertical elevational view of a conventional cross section which illustrates the improved portable firearm of the sub-machine gun type subject of the present invention and shows the stock and the guiding means of the bolt in fragmented views.

This invention refers to firearms and, more specifically, to an improved portable firearm of the rapid fire (sub-machine gun) type 11 with an open breech and which includes, as do all firearms of this type, a barrel 12, a bolt 13, a handle or grip 14, a stock 15, sight means 16 firing means 17 and safety means 18, except that, unlike other known firearms of this type, said elements are mounted upon a support structure 19, as is illustrated in FIGS. 1 and 2.

Figure 4:
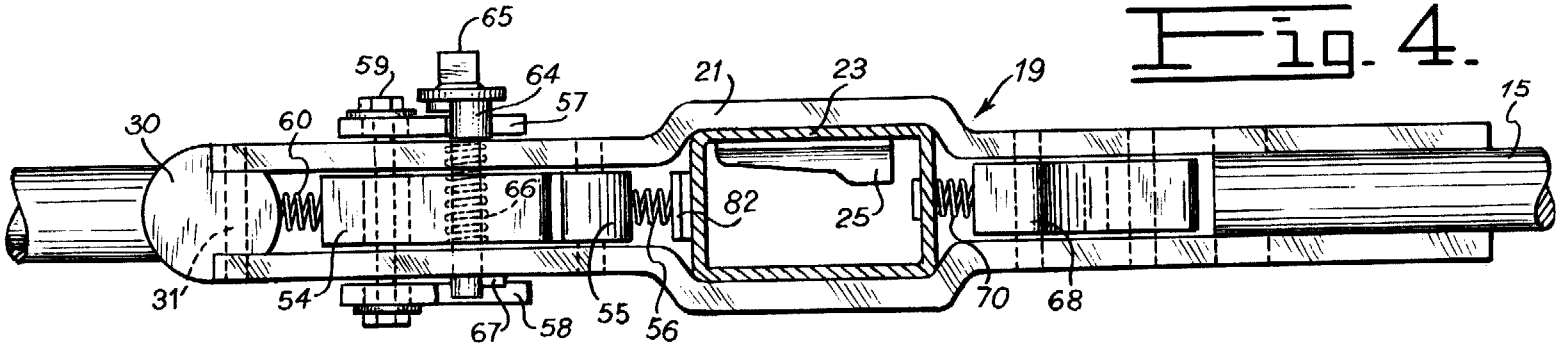
FIG. 4 is a bottom plan view which illustrates the support structure which is shown in FIG. 3.

The support structure 19, as can be seen in detail in FIGS. 3 and 4, is an "H" shaped bar which has its joining portion near one end. Said joining portion or saddle of said H shaped bar is projected upwardly in such a way that it forms a channel 20, in which the barrel 12 is adequately secured by its rear end, for the purpose only the chamber of the barrel 12 will be outside the projection 20 on one side, and on the other side the front end portion of the barrel will be located well away from the support structure 19.

Towards the middle portion, which in this case is behind the channel 20, the support structure 19 has a widened portion 21 which provides a housing which is adequate for locating therein by welding a retaining device 23 for a magazine 24. This retaining device 23 has at its upper end portion and fixed to the support structure 19 by means of rivets 22, an ejector 25 to expel an empty shell once a cartridge is fired, said ejector 25 being a projecting member which is slightly bent along its upper edge and which has a cut in one of its upper corners.

At the end of the H-shaped support structure 19, behind the said widened portion 21, the upper end portion of the stock 15 is fixed, said stock 15 having its other or lower end portion secured to the lower end portion of the magazine retaining device 23. At said point, as may be seen in FIG. 2, there is a pawl type lever 26 which is spring loaded by a spring 27 and which protrudes into the interior of the magazine retaining device 23 and thus keeps the magazine 24 within the retaining device 23 by pressure. Thus if desired, said magazine 24 may be separated from the retaining device 23 by pushing the lever 26 forcing it against the spring 27, so said magazine 24 is freed to slide outside of the said magazine retaining device 23.

Around the magazine retaining device 23 there is included a cover which is fixed thereto by means of a pin 28 and which constitutes the grip 14 of the firearm 11 and for which purpose said cover is made of material which is appropriate and includes on its two faces having the largest surface areas grooves 29 which provide a better grip of the firearm 11.

The front end portion of the support structure 19, which is to say the portion which is opposite the end to which stock 15 is attached, is closed by means of a solid cylindrical body 30, thus giving to this end a rounded appearance. The solid cylindrical body 30 is fixed to the support structure 19 by means of pins 31. This may be clearly seen in FIG. 4.

Figure 7:
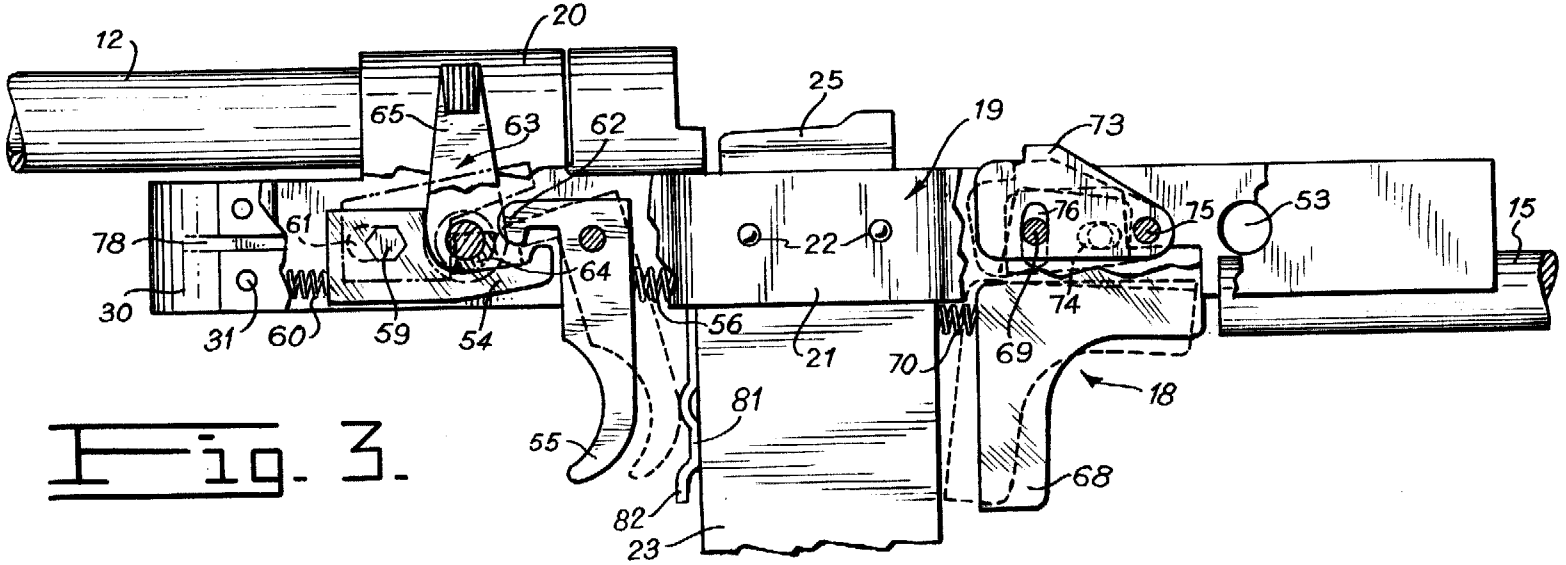
FIG. 7 is a rear vertical elevational view which illustrates the bolt of the firearm of the present invention.
Figure 5:
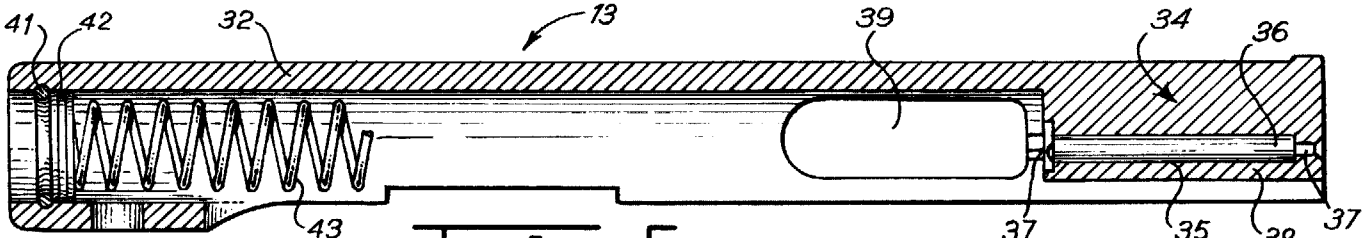
FIG. 5 is a vertical elevational view of a conventional cross section which illustrated the bolt of the firearm of the present invention, and shows the spring which propels it, in a fragmented views.
Figure 6:
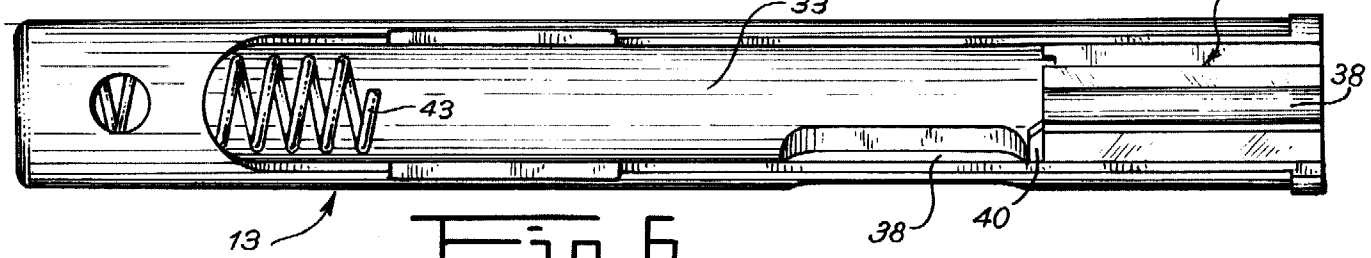
FIG. 6 is a bottom plan view which illustrates the bolt of the firearm, subject of the present invention.
Figure 7:
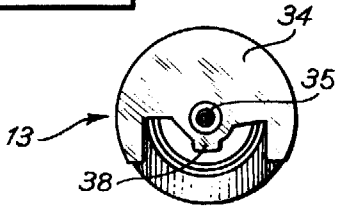

On the barrel 12 the bolt 13 is slidingly mounted, the length of said bolt 13 being substantially equal to the length of said barrel 12, but which covers said barrel 12 only partially, leaving the front end of said barrel 12 free. The said bolt 13, as shown in FIGS. 5 through 7, is a tubular member 32 partially open along its lower edge by means of a longitudinal cut 33 and closed along its back end portion by a solid support member 34, the front end of which solid support member 34 registers with the barrel chamber 12, when the bolt 13 is at the end of its path, that is to say, the firearm 11 has not been cocked or has been fired with only one cartridge in the magazine 24.

The solid support member 34 has a cylindrical channel 35, in which the firing pin 36 is carried, the diameter of which channel 35 is sharply contracted towards its back portion in order to form a back which prevents the firing pin 36 from coming out the back end of the bolt 13. The lower edge of the solid support member 34, as may easily be seen in FIG. 7, is formed in the shape of a rail 38 in order to allow sliding contact with the ejector 25 along its entire length, by means of which the bolt 13 is guided to the end of its path while the firearm 11 is functioning.

The firing pin 36 is invertable and reusable, inasmuch as it has on each end a point 37 by means of which it can ignite the cartridge. This firing pin 36 is a metal bar which is slightly bent before it is tempered and therefore it is not perfectly straight; and when it is introduced into the channel 35 it becomes lodged with enough pressure to give it a degree of fixation.

The tubular member 32 has on the back portion, near the solid support member 34 and near said cut 33, an opening or window 39, the back end of which is integrated with a groove (not illustrated) which has in its interior a small bar tiltingly attached, said bar having its front end bent in the form of a hook, and functioning as a puller finger 40 to remove the empty shell from the inside of the chamber.

The bolt 13 comprises, near its front end or mouth, an interior stop 41 which is fixed thereto and which is formed by an open ring lodged in a peripheral interior groove near the mouth of said bolt 13. The stop 41 holds a bushing 42 which is welded to an end of a helical spring 43, which spring 43 guides, pushes and provides the functioning travel of the bolt 13, and has a length slightly greater than that of the bolt 13. The diameter of bushing 42 is such that it lies in the clearance which exists between the exterior diameter of the barrel 12 and the interior diameter of the bolt 13 and which furthermore maintains the concentricity of of both elements, whereby the bolt 13 freely slides over the barrel 12.

On its upper front end portion, the bolt 13 has a projecting part which is formed as a ledge 44 to permit easily drawing the bolt 13 against the spring 43 and moving it to the firing position. This ledge 44, in order that it may be operated by only one finger, has a slight concavity at its front end. This ledge 44 since it is hollow, is also used to enclose and at the same time protect the front sight which establishes the line of aiming of the sight means 16.

The bolt 13 is also partially guided at its outer end by a guide 45 removably joined to the support structure 19 by means of a pin 46 which is removable and by runners 47 which are integral with said guide 45.

The pin 46 is a smooth pin, which has in the end opposite its head a pivotal tongue 48 fixed by a shaft 49. The said tongue 48 has, from its middle portion to its end, a slot 50; the end of the slot 50 which registers with the center of the tongue 48 is enlarged. A spring 51 encompasses the shaft of pin 46 and presses against the head of pin 46, thus applying pressure against tongue 48 when said tongue 48 is crosswise to the pin 46, after said pin 48 has been introduced through openings 52 in the runners 47 and matching openings 53 in the support structure 19 in order to mount the guide 45 in said support structure 19.

In the interior of the support structure 19 near the widened portion 21 and at each end of the same, the firing means 17 and the safety means 18 are included.

The firing means 17, as can be clearly seen in FIGS. 2 through 4 and 13 through 14, is comprised of three levers, there being one central lever 54 which is located in the interior of the support structure 19 and is the mechanism brought into action by a trigger 55, when the latter is forced against a spring 56 and thus fires the shot. The other two levers are located outside the support structure 19 and are detention levers 57 and 58 of the bolt 13 in the initial position of its travel, which is to say in the position of preparation for firing. In this manner, once the central lever 54 is brought into action by the trigger 55, the lever 54 tilts downward, providing the same movement for the detention levers 57 and 58 because said three levers 54, 57 and 58 have a common axis 59 which is partially polyhedral, in this case hexagonal, in its end portions and in its middle poriton, on which said portions the three said levers 54, 57 and 58 are mounted. This common shaft 59 is cylindrical in those portions which are carried in the support structure 19, in such a way that they can tilt freely relative to said support structure 19. Therefore, in the foregoing operation, the bolt 13 is freed from the action of the detention levers 54, 57 and 58 and the firearm 11 is fired in this fashion.

So then, as has already been stated, the detention levers 57 and 58 provide the initial position of travel of the bolt 13. This position is achieved by manually forcing bolt 13 against spring 43 by means of ledge 44 until the said detention levers 57 and 58 fall into place in some identations made in the longitudinal cut 33 near the front end of said bolt 13. These levers 57 and 58 drop into place by the action of a spring 60 of the firing means 17 which forces said levers 57 and 58 into a raised position and for this reason, once the indentations in the longitudinal cut 33 reach the detention levers 57 and 58 the latter are lifted up and at the same time hold the bolt 13 at the point where they strike the rear ends of the said indentations. With this movement of the bolt 13 into position for firing, in the event that there is an empty shell in the chamber of the barrel 12, the puller finger 40 will pull it out of said chamber until said empty shell is thrown outside of the firearm 11 through the window 39 by action of the ejector 25 at the moment that the latter registers with said window 39.

In order for the central lever 54 to be activated by the trigger 55 it must necessarily be forced against the spring 60 which has one of its ends fixed to the end of the central lever 54, opposite the trigger 55 and its other end fixed to the solid cylindrical body 30 in the support structure 19. This position is provided by the bolt 13 at the initial point of its travel when held in place by the detention levers 57 and 58; made and it is possible because the common shaft 59 of said detention levers 57 and 58 is mounted in the support structure 19 through openings 61 which are slightly elongated, whereby the three levers 54, 57 and 58 have a slight sliding action in order that the central lever 54 registers with a catch 62 of the trigger 55 which activates the firing means 17.

In order to select the type of firing to be done with the firearm 11, subject of the present invention, which may be repeating fire,, single shot, or automatical, there is included in the firing means 17 a firing selector 63. This selector 63 comprises a shaft one end portion 64 of which is cut at an angle, and at this same end it also has a positioning device 65 by means of which the selector 63 is positioned for the type of firing desired. The selector 63 is fixed, by means of its shaft, to the support structure 19 pressing against a spring 66 and fixed by means of a retainer pin 67 which is located in the end opposite the positioning device 65, and which is lodged in some slots (not illustrated) of the support structure 19 which have the same positions as those of the selector 63 and therefore said positions are obtained in a precise fashion.

It may be said that the selection of the type of firing is really provided by the indented portion 64 inasmuch as its cut angle allows the detention lever 57, which registers the same and furthermore has a base which is slightly larger than that of the other detention lever 58, to remain in a different position in the elongated opening 61, and to remain fixed or not in its tilting movement according to the type of firing desired. For example, as shown in FIG. number 3, when the positioning device 65 is placed vertically upward, the cut of the indented portion 64 allows the detention lever 57 to remain completely free to slide along the whole length of the elongated opening 61, and its tilting movement to be total. Consequently, once the bolt has been released, said levers 54, 57 and 58 return to their initial position in the elongated opening 61 and the central lever 54 remains out of engagement with the catch 62 of the trigger 55.

Accordingly, in order for the three levers 54, 57 and 58 to move into an adequate firing position, the trigger 55 must be allowed to return to its initial position in order for the bolt 13, moved by the gases caused by the firing to return to its initial position of travel and be held there by the detention levers 57 and 58; and with this position the central lever 54 now registers with the catch 62 of the trigger 55 and the firing means 17 may be activated by once again squeezing the trigger 55. So then, we may deduce from the foregoing that the said vertical position of the selector 63 provides a repeating or shot-by-shot type of firing, and in this mode every time a new shot is desired the trigger 55 must be squeezed.

Figure 13:
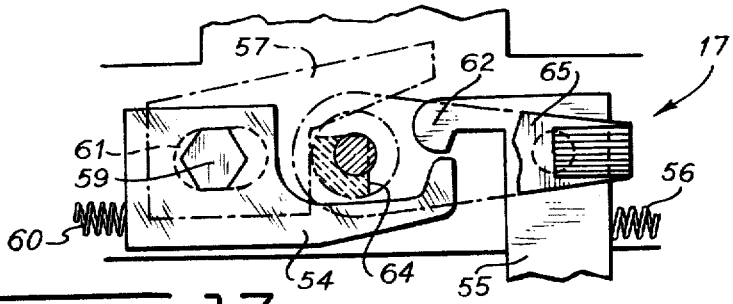
FIG. 13 is a vertical fragmented elevational side view which illustrates the firing means of the firearm of this invention, in position for automatic firing.

Another type of firing of the firearm 11 which is the subject of this invention is that which is provided by the position of the firing means 17 which is shown in FIG. 13. In this case the positioning device 65 is in a horizontal position which leaves the cut of the indented portion 64 so placed that levers 54, 57 and 58, by means of detention lever 57, are pressed against the spring 60 at the end of the elongated opening 61, opposite the trigger 55. Therefore, the common shaft 59 of said levers remains fixed in this position and by this means the central lever 54 always remains registering, with the catch 62 in order to be activated by the trigger 55 in an uninterrupted fashion; because, the central lever 54 never escapes the action of the trigger 55, as already stated, since as a result of the gases let off by the firing, and the bolt 13 returns and moves into its initial position of its travel, allowing the firearm 11 to function continuously as long as the trigger 55 is squeezed and there are cartridges which provide the proper pressure by means of the gases given off upon firing.

Figure 14:
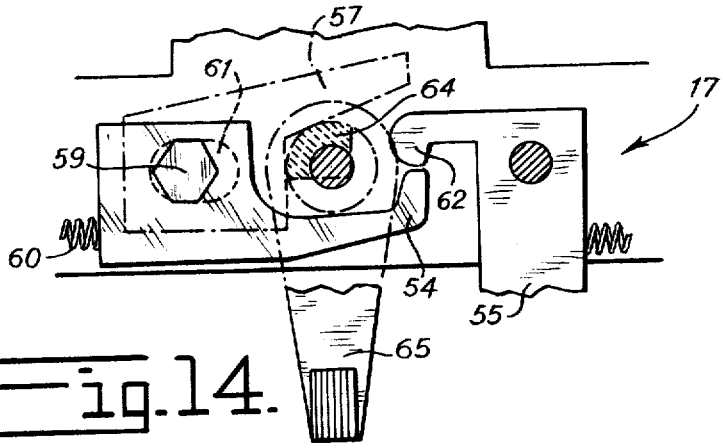
FIG. 14 is a vertical elevational side view similar to FIG. number 13 which illustrates the firing mechanism of the firearm of this invention, in the safety position.

A third position provided by the selector 63 is the safety position, which is illustrated in FIG. 14. This safety position is achieved when the positioning device 65 is in a vertical position downward and prevents the detention levers 57 and 58 from freeing the bolt 13, and therefore there is no firing. In this case the indented portion 64 remains in such a position that its uncut part bears against the detention lever 57 as a result of its wider base and blocks it, forcing the levers 57 and 58 to lodge in the slots of the lengthwise cut 33, i.e., in the position of detention of the bolt 13. Consequently, although the central lever 54 remains registering with the catch 62 of the trigger 55 since the three levers 54, 57 and 58 remain in the end of the elongated opening 64 opposite the trigger 55, when the latter is squeezed the tilting movement of the central lever 54 is prevented. This happens because the detention lever 57 is fixed and as a result of the effect of the common shaft 59, because as we know, by virtue of said common shaft 59 the three levers 54, 57 and 58 have a simultaneous movement.

In addition to the safety provided by the selector 63, we have the specific safety means 18. This safety means 18 is such that it prevents the firearm 11 from being fired unless said safety is gripped, inasmuch as otherwise it prevents the bolt 13 from moving to the initial position of its travel, in other words, the firearm cannot be cocked. The safety mechanism 18 can be readily seen in FIGS. 2 and 3. This mechanism is mounted in the support structure 19 behind the widened portion 21 of same, and comprises an activating lever 68 which is square-shaped and which has a tilting movement with relation to the support structure 19, since it is thereon mounted by means of a shaft 69 and since it is spring loaded on the back side of the magazine retaining device 23 by a spring 70. This square-shaped piece results the activating lever 68; because the portion of this piece extending into the support structure 19 includes projections 71 which pivotingly support safety plates 73 by means of shaft 72 that passes through horizontally elongated holes 74. Said safety plates 73 are pivoted at one end to support structure 19 by means of shaft 75, and have a vertically elongated hole 76 in their portion registering with shaft 69 of the activating lever 68, to enable bolt 13 to slide to the starting position of its travel; thus they provide proper functioning of the safety means 18.

The aforementioned fuction is clearly illustrated with dotted lines in FIG. 3 and works as follows: upon pushing the activating lever 68 against the spring 70 the safety plates 73 are lowered and as has already been said, allow bolt 13 to be moved into the initial position of its travel. Therefore, due to the fact that the activating lever 68 is located in the grip 14 in that portion opposite the trigger 55, each time the firearm 11 is gripped the safety means 18 is released and the only way in which to release the safety except by gripping the gun, is by specifically pressing the lever 68.

Figure 9:
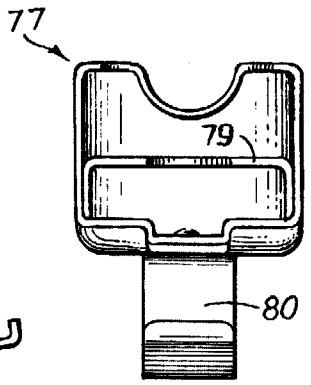
FIG. 9 is a rear vertical elevational view which illustrates the open cover for hand grip of the firearm of the present invention.
Figure 8:
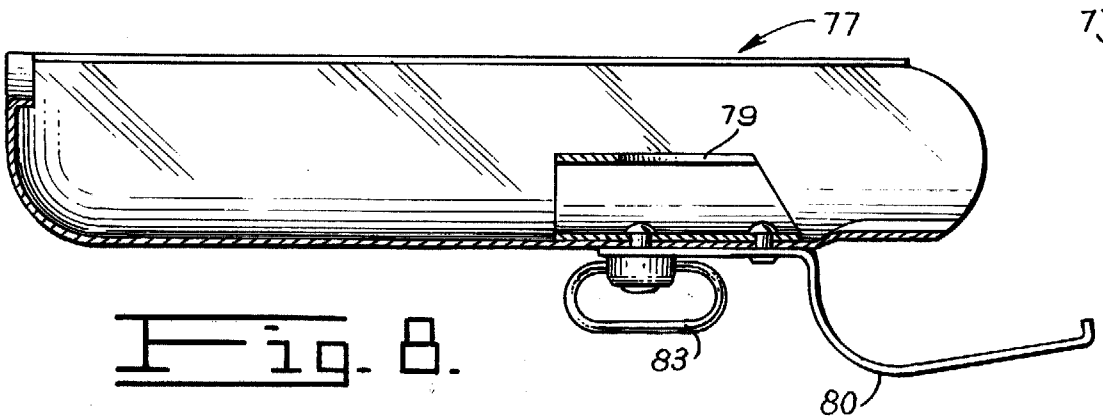
FIG. 8 is a vertical elevational view of a conventional cross section which illustrates the open cover for hand grip of the firearm of the present invention.
Figure 10:
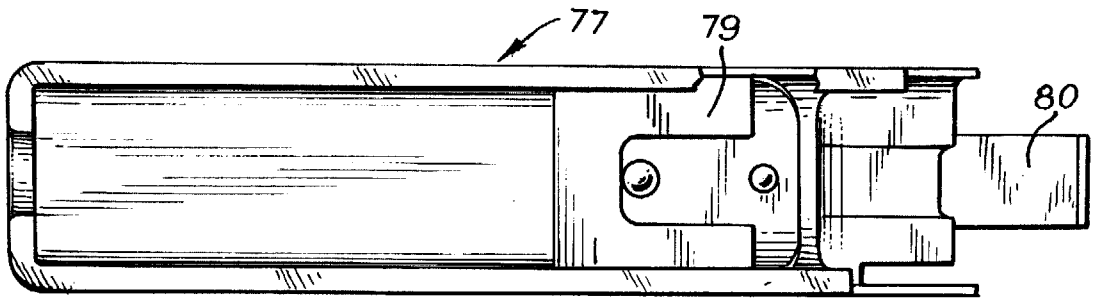
FIG. 10 is a top plan view which illustrates the open cover for hand grip of the firearm of the present invention.
Figure 11:
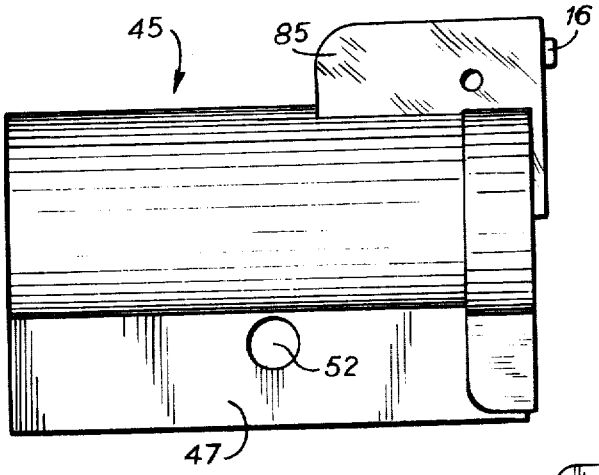
FIG. 11 is a vertical elevational side view which illustrates the guiding means of the bolt of the firearm of the present invention.
Figure 12:
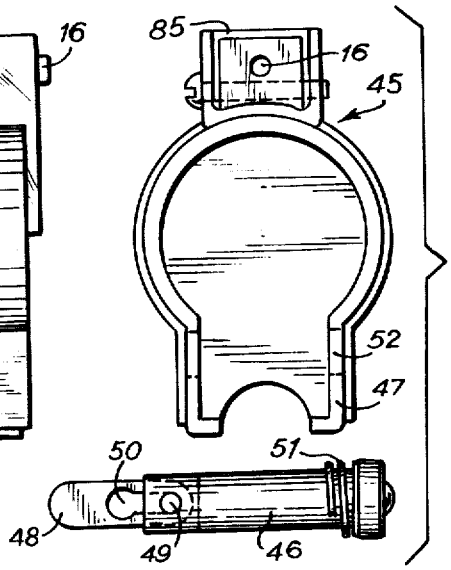
FIG. 12 is a front vertical elevational view which illustrates the guiding means of the bolt of the firearm of this invention.

In order to provide a point of hand support in the front part of the firearm 11 subject of this invention an open cover 77 is attached to the support structure 19 which is shown in FIGS. 8 through 10. This cover 77 is fixed by means of two connections: on one side to the support structure 19 by means of slots 78 included in the front end of said support structure 19 in which slots 78 a rail plate 79 slides, said rail plate 79 being secured in the inner back portion of the open cover 77; and on the other side, to the magazine retaining device 23 by means of a metal strip 80 which is slightly turned up at its free end, which free edge attaches to the front face of the said retaining device 23 by means of a bar 81. Said bar 81 has in its upper end portion an opening in which one end of the spring 56 of trigger 55 is lodged, by means of which spring 56 the slipping of trigger 55 is avoided and the proper support of same is given. On its lower end, bar 81 has an angular lip which forms a channel 82 in which the metal strip 80 is lodged due to the tension of its free end. In this way the open cover 77 remains fully secured to the support structure 19 and trigger 55 is provided with a guard by the metal strip 80; furthermore, a ridge included in bar 81 acts as a stop for trigger 55 when it is pulled.

Said open cover 77 on the rear end near the metal strip 80 carries a pivotal ring 83 which supports one end of a belt 84 the other end of which is supported by the stock 15 as shown in FIG. 1.

As previously noted the front sight is located within the ledge 44 on the front end of the bolt 13; therefore in order to have a line of aiming an opening is needed, which opening is located in a rear sight 85 which is a raised element movably connected to the upper rear end of guide 45 opposite bolt 13, thus constituting the complete sight assembly for aiming. Inasmuch as the rear sight 85 is laterally adjustable, it may be said that the sight means 16 is adjustable for windage. This type of adjustment is required because for the use of this type of firearm the aim must be exact in the transverse axis of the target.

From the foregoing description we observe that the present invention provides a firearm 11 with a great many advantages over known firearms, which advantages have been fully indicated. Nevertheless, in a short summary we may say that they are:

The bolt 13 is exposed which avoid interference in its functioning. Said bolt 13 covers almost the entire barrel 12; hence it is a very short firearm, thus allowing the stock 15 to be fixed. It includes a safety 63 which prevents the firearm 11 from being fired except when it is gripped. It is a firearm 11 with very few estructural elements and therefore is very light and easy to arm and to take to pieces without any tools and in a very short time.

Although the foregoing description was made in relation to one specific model of the invention, it must be understood by all of those who are experts in this field that any change whatsoever in form or detail will be comprised within the field and scope of the same.

I claim:

1. A portable submachine gun comprising a support structure having upper and lower edges and front and rear ends and exteriorly including a pair of opposite slots at said front end; firing and safety means attached to said support structure; a retaining device for a magazine attached to said support structure; a stock attached to the rear end of the support structure and to said magazine retaining device; a barrel attached to said support structure and having a cartridge receiving chamber at one end; and a bolt slidingly mounted on said barrel and having guide means removably attached to the rear end of said support structure; in which a handling support means is removably coupled to the front end portion of said support structure and to said magazine retaining device; and a said handling support means comprises an open cover including upper and rear open ends, a rail plate interiorly included in said open cover in its rear end portion whereby said cover is slidingly coupled in said slots of the front end of the support structure, and a metal strip exteriorly fixed to the rear end portion of said open cover, said metal strip being free at one of its end portions and slightly bent whereby the handling support means is coupled to the magazine retaining device.

* * * * *